US011365022B2

(12) United States Patent
Altman et al.

(10) Patent No.: US 11,365,022 B2
(45) Date of Patent: Jun. 21, 2022

(54) CHILD-RESISTANT CONTAINER ASSEMBLY

(71) Applicant: RIPA, LLC, Broadview, IL (US)

(72) Inventors: Jason Altman, Los Angeles, CA (US); Hector Lemos, San Gabriel, CA (US)

(73) Assignee: RIPA, LLC, Broadview, IL (US)

( * ) Notice: Subject to any disclaimer, the term of this patent is extended or adjusted under 35 U.S.C. 154(b) by 463 days.

(21) Appl. No.: 16/514,697

(22) Filed: Jul. 17, 2019

(65) Prior Publication Data

US 2021/0016918 A1 Jan. 21, 2021

(51) Int. Cl.
*B65D 5/44* (2006.01)
*B65D 43/20* (2006.01)

(52) U.S. Cl.
CPC ..... *B65D 5/44* (2013.01); *B65D 43/20* (2013.01); *B65D 2215/00* (2013.01)

(58) Field of Classification Search
CPC ..... B65D 5/44; B65D 43/20; B65D 2215/00; B65D 5/38; B65D 50/04
USPC ..... 5/427; 206/1.5; 229/117.22, 23, 117.32, 229/129, 129.1, 913, 936
See application file for complete search history.

(56) References Cited

U.S. PATENT DOCUMENTS

| | | | | |
|---|---|---|---|---|
| 625,757 | A | 5/1899 | Groneman | |
| 1,540,553 | A | 6/1925 | Graham | |
| 2,231,726 | A | 2/1941 | Looke, Jr. | |
| 3,987,891 | A | 10/1976 | Horvath | |
| 4,189,087 | A * | 2/1980 | Dlugopolski | B65D 5/38 229/125.125 |
| 4,401,210 | A | 8/1983 | Anjou | |
| 4,561,544 | A | 12/1985 | Reeve | |
| 4,741,433 | A | 5/1988 | Irvine | |
| 4,844,284 | A | 7/1989 | Drozd | |
| 6,491,211 | B1 | 12/2002 | Evans | |
| D594,742 | S | 6/2009 | Meier | |
| D674,691 | S | 1/2013 | Martineck | |
| D702,116 | S | 4/2014 | Buchanan | |

(Continued)

FOREIGN PATENT DOCUMENTS

CN 306074583 9/2020

OTHER PUBLICATIONS

GrowCargo.com, "Grow Cargo Child Resistant Slide Box," Web page, <URL:https://growcargo.com/products/child-resistant-certified-biodegradable-exit-boxes/>; Retrieved from the Internet on Jan. 26, 2021 (4 pages).

*Primary Examiner* — Anthony D Stashick
*Assistant Examiner* — Raven Collins
(74) *Attorney, Agent, or Firm* — Nixon Peabody LLP

(57) ABSTRACT

A container assembly includes an outer sleeve, a slide-out tray and a pop-up carton. The first and second sides of the outer sleeve have at least a double thickness adjacent to first and second outer sleeve apertures formed therein. The slide-out tray includes a first side with a minor first side flap folded thereon and a second side with a minor second side flap folded thereon. The slide-out tray is received in the outer sleeve. The pop-up carton is attached to the slide-out tray and located within the slide-out tray in a first position. The slide-out tray initially moves with respect to the outer sleeve by contacting the first and second side flaps via respective first and second outer sleeve apertures and the slide-out tray via a third outer sleeve aperture. The pop-up carton is moved within the slide-out tray to a position extending from the slide-out tray.

19 Claims, 9 Drawing Sheets

(56) References Cited

U.S. PATENT DOCUMENTS

| | | | | |
|---|---|---|---|---|
| D747,190 | S | 1/2016 | DeLaGrange | |
| D795,083 | S | 8/2017 | Safiullin | |
| D831,495 | S | 10/2018 | Papiemik-Berkhauer | |
| D863,056 | S | 10/2019 | Luna | |
| D867,129 | S | 11/2019 | Chambers | |
| 10,518,927 | B2 | 12/2019 | Chambers | |
| D878,196 | S | 3/2020 | Tsai | |
| D878,197 | S | 3/2020 | Griffin | |
| 10,638,821 | B2 * | 5/2020 | Hwang | A47F 7/03 |
| D899,247 | S | 10/2020 | Kilduff | |
| 2004/0099565 | A1 | 5/2004 | Dehlin | |
| 2011/0186469 | A1 | 8/2011 | Sack | |
| 2016/0001937 | A1 | 1/2016 | Skinner | |
| 2016/0251107 | A1 | 9/2016 | Everett | |
| 2017/0036808 | A1 | 2/2017 | Everett | |
| 2019/0062023 | A1 | 2/2019 | Lantz | |
| 2019/0185247 | A1 * | 6/2019 | Sollie | B65D 81/3858 |
| 2019/0375537 | A1 * | 12/2019 | Nakovski | B65B 5/04 |
| 2020/0087020 | A1 | 3/2020 | Tsai | |
| 2020/0087021 | A1 | 3/2020 | Tsai | |
| 2020/0102113 | A1 | 4/2020 | Laughlin | |

* cited by examiner

CHILD-RESISTANT CONTAINER ASSEMBLY

FIELD OF THE INVENTION

The present invention relates generally to containers. In particular, the present invention relates to containers that are child-resistant.

BACKGROUND

Flat sheets of paperboard, typically referred to as blanks, have been used for many years as the starting material to form containers. Paperboard containers may be made of single or multiple layers. Containers are adapted to contain and secure a product. Some of these products are not meant or desired for children. Thus, with these types of products, it is often desirable to have child-resistance features associated with the container to prevent or inhibit children from gaining access to the product located within the container.

In addition to having a child-resistant container or container assembly, it is desirable to have other attributes such as a container or container assembly that is easy to pack with product, sturdy and fully enclosed for protection of contents during storage and shipping, and aesthetically pleasing to customers.

Therefore, it would be desirable to have a child-resistant container assembly that addresses many, if not all, of these attributes.

SUMMARY

According to aspects of the present disclosure, a container assembly includes an outer sleeve, a slide-out tray and a pop-up carton. The outer sleeve includes a front, a back, first and second sides, a top and an open end opposite of the top. The first and second sides form respective first and second outer sleeve apertures. At least one of the back and the top of the outer sleeve forms a third outer sleeve aperture. The first and second sides have at least a double thickness adjacent to the first and second outer sleeve apertures. The slide-out tray includes a front, a back, first and second sides, and a bottom. The slide-out tray forms an elongated area. The first side of the slide-out tray includes at least one minor first side flap folded thereon. The second side of the slide-out tray includes at least one minor second side flap folded thereon. The slide-out tray is received in the open end of the outer sleeve. The pop-up carton includes a front, a back, first and second sides, a bottom, and a top. The pop-up carton is attached to the slide-out tray and is located within the elongated area of the slide-out tray in a first position.

The slide-out tray is configured to initially move with respect to the outer sleeve by contacting (a) the at least one minor first side flap of the slide-out tray via the first outer sleeve aperture, (b) the at least one minor second side flap of the slide-out tray via the second outer sleeve aperture, and (c) the slide-out tray via the third outer sleeve aperture. The pop-up carton is moved from the first position within the slide-out tray to a second position extending from the slide-out tray during the movement of the slide-out tray with respect to the outer sleeve.

According to another embodiment, a container assembly includes a first blank, a second blank and a third blank. The first blank includes a first plurality of panels and a first plurality of flaps integrally formed from a first sheet of material configured to form an outer sleeve. The first plurality of panels includes a first side panel, a second side panel, a back panel, and a front panel of the outer sleeve. The first side panel forms a first outer sleeve aperture. The second side panel forms a second outer sleeve aperture. The first plurality of flaps forms a top of the outer sleeve. The first plurality of flaps includes at least one first side flap and at least one second side flap. The at least one first side flap is configured to form at least a double thickness portion adjacent to the first outer sleeve aperture. The at least one second side flap is configured to form at least a double thickness portion adjacent to the second outer sleeve aperture. The second blank includes a second plurality of panels and a second plurality of flaps integrally formed from a second sheet of material configured to form a slide-out tray. The second plurality of panels includes a first side panel, a second side panel, a back panel, and a front panel of the slide-out tray. The front panel includes an elongated aperture. The second plurality of flaps includes at least one minor first side flap configured to be folded on the first side panel and at least one minor second side flap configured to be folded on the second side panel. The third blank includes a third plurality of panels and a third plurality of flaps integrally formed from a third sheet of material configured to form the pop-up carton. The third plurality of panels includes a first side panel, a second side panel, a back panel, and a front panel of the pop-up carton. The third plurality of flaps forms a bottom and a top of the pop-up carton.

The slide-out tray is configured to be received in the outer sleeve. The pop-up carton is configured to be attached to the slide-out tray. The slide-out tray is configured to initially move with respect to the outer sleeve by contacting (a) the at least one minor first side flap of the slide-out tray via the first outer sleeve aperture, (b) the at least one minor second side flap of the slide-out tray via the second outer sleeve aperture, and (c) the slide-out tray via the third outer sleeve aperture. The pop-up carton is configured to move from the first position within the slide-out tray to a second position extending from the slide-out tray during the movement of the slide-out tray with respect to the outer sleeve.

According to one method of accessing product from a child-resistance container assembly, an outer sleeve is provided and includes a front, a back, first and second sides, a top and an open end opposite of the top. The first and second sides form respective first and second outer sleeve apertures. At least one of the back and the top of the outer sleeve forms a third outer sleeve aperture. The first and second sides have at least a double thickness adjacent to the first and second outer sleeve apertures. A slide-out tray is provided that includes a slide-out tray having a front, a back, first and second sides, and a bottom. The slide-out tray forms an elongated area. The first side of the slide-out tray includes at least one minor first side flap folded thereon. The second side of the slide-out tray includes at least one minor second side flap folded thereon. The slide-out tray is received in the open end of the outer sleeve. A pop-up carton is provided and includes a pop-up carton having a front, a back, first and second sides, a bottom, and a top. The pop-up carton is attached to the slide-out tray and is located within the elongated area of the slide-out tray in a first position.

The sliding tray is moved with respect to the outer sleeve by contacting (a) the at least one minor first side flap of the slide-out tray via the first outer sleeve aperture, (b) the at least one minor second side flap of the slide-out tray via the second outer sleeve aperture, and (c) the slide-out tray via the third outer sleeve aperture. The pop-up carton is moved from the first position within the slide-out tray to a second position extending from the slide-out tray during the movement of the slide-out tray with respect to the outer sleeve such that product is removable.

According to a further embodiment, a container assembly includes an outer sleeve, a slide-out tray and a pop-up carton. The outer sleeve includes a front, a back, first and second sides, a top and an open end opposite of the top. The outer sleeve further includes a minor front flap. The first and second sides form respective first and second outer sleeve apertures. At least one of the back and the top of the outer sleeve forms a third outer sleeve aperture. The first and second sides have at least a triple thickness adjacent to the first and second outer sleeve apertures. The slide-out tray includes a front, a back, first and second sides, a bottom, and first and second interior side walls. The slide-out tray forms an elongated area. The first side of the slide-out tray includes at least one minor first side flap folded thereon. The second side of the slide-out tray includes at least one minor second side flap folded thereon. The slide-out tray is received in the open end of the outer sleeve. The pop-up carton includes a front, a back, first and second sides, a bottom, and a top. The pop-up carton is attached to the slide-out tray and is located within the elongated area of the slide-out tray in a first position. The pop-up carton further includes first and second pop-up tab sections.

The slide-out tray is configured to initially move with respect to the outer sleeve by contacting (a) the at least one minor first side flap of the slide-out tray via the first outer sleeve aperture, (b) the at least one minor second side flap of the slide-out tray via the second outer sleeve aperture, and (c) the slide-out tray via the third outer sleeve aperture. The pop-up carton is moved from the first position within the slide-out tray to a second position extending from the slide-out tray during the movement of the slide-out tray with respect to the outer sleeve. The first and second pop-up tab sections and the minor front flap of the outer sleeve assist in moving the pop-up carton between the first and second positions.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
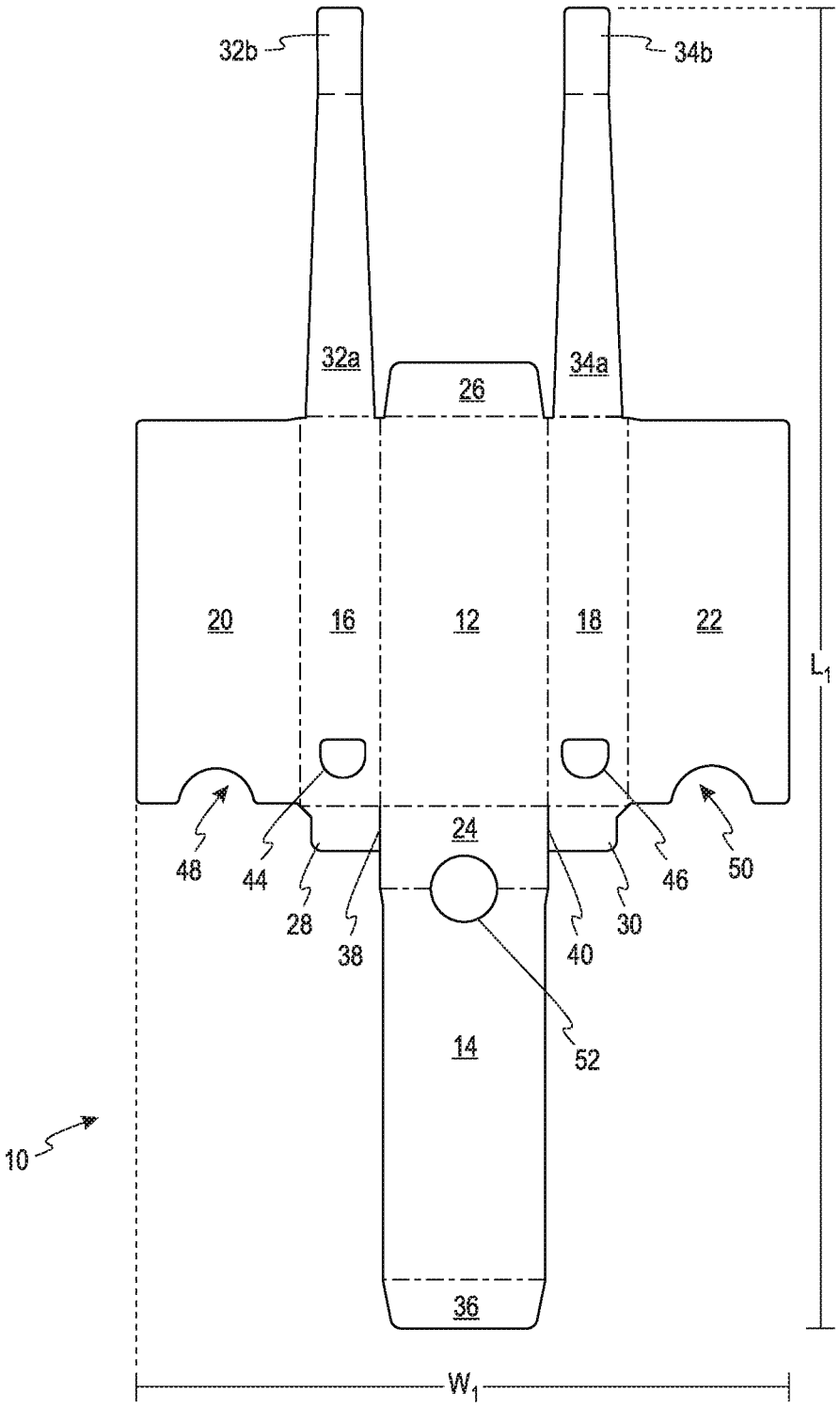
FIG. 1A is a top plan view of a first blank for forming an outer sleeve to be used in a container assembly according to one embodiment of the present disclosure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIG. 1A illustrates a top plan view of a blank 10 for forming an outer sleeve (also referred to as an "outer sleeve blank") to be used in a child-resistant container assembly according to one embodiment of the present disclosure. The outer sleeve blank 10 includes a plurality of panels and a plurality of flaps. Specifically, the outer sleeve blank 10 includes a front panel 12, a back panel 14, a first side panel 16 and a second side panel 18. Adjacent panels 16, 12, 18 are connected with one another by substantially parallel fold lines as shown in FIG. 1A. The first side panel 16 forms an aperture 44, while the second side panel 18 forms an aperture 46. The apertures 44, 46 are shown as being a generally semicircle shape in FIG. 1A. It is contemplated that the apertures may be other shapes than that depicted in FIG. 1A.

The outer sleeve blank 10 further includes a first major back flap 20, a second major back flap 22, a first minor top flap 24, a first minor front flap 26, a second minor top flap 28, a third minor top flap 30, a first major side flap 32*a*, a first minor side flap 32*b*, a second major side flap 34*a*, a second minor side flap 34*b* and a first minor back flap 36. The first major back flap 20 and the second major back flap 22 are hingedly connected to the first side panel 16 and the second side panel 18, respectively, via fold lines. As shown in FIG. 1A, the first major back flap 20 forms a cutout 48 along its periphery, while the second major back flap 22 forms a cutout 50 along its periphery. The cutouts 48, 50 are generally semicircle in shape.

The first minor top flap 24 is hingedly connected between the front panel 12 and the back panel 14 via fold lines. The first minor top flap 24 and the back panel 14 together form an aperture 52. The aperture 52 is generally circular in FIG. 1A. The shape of the cutouts 48, 50 is desirably configured to be consistent with a portion of the shape of the aperture 52 as will be discussed below. It is contemplated that the shapes of the cutouts 48, 50 and the aperture 52 may be different than depicted in FIG. 1A.

The first minor front flap 26 is hingedly connected to the front panel 12 via a fold line and is located opposite of the first minor top flap 24. The second minor top flap 28 and the third minor top flap 30 are hingedly connected to the first side panel 16 and the second side panel 18, respectively, via fold lines. The second and third minor top flaps 28, 30 are located adjacent to the first minor top flap 24 and are separated by cut lines 38, 40, respectively.

The first and second major side flaps 32*a*, 34*a* are hingedly connected to the first side panel 16 and the second side panel 18, respectively, via fold lines. The first major side flap 32*a* and first minor side flap 32*b* are hingedly connected by a fold line. The second major side flap 34*a* and the second minor side flap 34*b* are hingedly connected by a fold line. The first and second major side flaps 32*a*, 34*a* are located opposite of the second and third minor top flaps 28, 30, respectively. The first minor back flap 36 is hingedly connected to the back panel 14 via a fold line.

Figure 2:
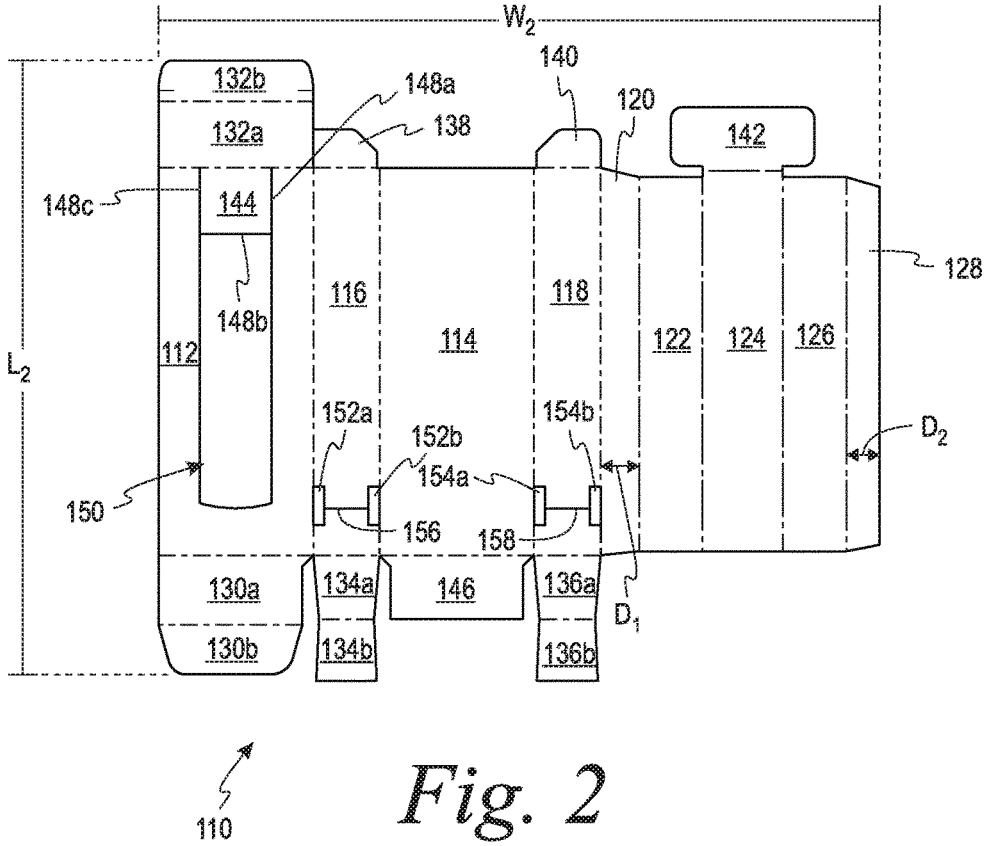
FIG. 2 is a top plan view of a second blank for forming a slide-out tray to be used in a container assembly according to one embodiment of the present disclosure.

Turning now to FIG. 2, a top plan view of a blank 110 for forming a slide-out tray (also referred to as an "slide-out tray blank") to be used in a child-resistant container assembly according to one embodiment of the present disclosure is shown. The slide-out tray blank 110 includes a plurality of panels and a plurality of flaps. Specifically, the slide-out tray blank 110 includes a front panel 112, a first back panel 114, a first side panel 116 and a second side panel 118. Adjacent panels 112, 116, 114, 118 are connected with one another by substantially parallel fold lines as shown in FIG. 2. The front panel 112 has an elongated aperture 150 formed therein. Each of the first side panel 116 and the second side panel 118 forms a plurality of small apertures 152*a*, 152*b* and 154*a*, 154*b*, respectively. The apertures 152*a*, 152*b* are connected via a cut line 156, while the apertures 154*a*, 154*b* are connected via a cut line 158. The apertures 152*a*, 152*b* and 154*a*, 154*b*, along with their respective cut lines, assist in proving some relief to pressure exerted by a user during the initial steps of opening the container assembly. As will be discussed below, the apertures 152*a*, 152*b* and 154*a*, 154*b*, along with their respective cut lines ultimately assist in allowing the slide-out tray to clear the thickness of the outer sleeve and move to an open position. It is contemplated that other shapes of apertures and cut lines may be used to relief the pressure exerted by a user during the initial steps of opening the container assembly. Thus, the first and second side panels 116, 118 have a respective selected area in which it is weakened to assist in opening the container assembly.

The slide-out tray blank 110 further includes a first minor front panel 120, a first interior side panel 122, a second back panel 124, a second interior side panel 126 and a second minor front panel 128. Adjacent panels 120, 122, 124, 126, 128 are connected with one another by substantially parallel fold lines as shown in FIG. 2.

The slide-out tray 110 also includes a first minor top flap 130*a*, a first minor back flap 130*b*, a first minor bottom flap 132*a* and a second minor back flap 132*b*. The first minor top flap 130*a* and the first minor back flap 130*b* are hingedly connected to each other via a fold line, and the first minor bottom flap 132*a* and the second minor back flap 132*b* are also hingedly connected to each other via a fold line. The first minor top flap 130*a* and the first minor bottom 132*a* are connected to the front panel 112 via respective fold lines and are located on opposing sides.

The slide-out tray blank 110 also includes first, second, third and fourth minor side flaps 134*a*, 134*b*, 136*a*, 136*b*, and second, third and fourth minor bottom flaps 138, 140, 142. The first and second minor side flaps 134*a*, 134*b* are hingedly connected to each other via a fold line, and the third and fourth minor side flaps 136*a*, 136*b* are hingedly connected to each other via a fold line. The first minor side flap 134*a* and the second minor bottom flap 138 are hingedly connected to the first side panel 116 and are located on opposing sides thereof. The third minor side flap 136*a* and the third minor bottom flap 140 are hingedly connected to the second side panel 118 and are located on opposing sides thereof. The fourth minor bottom flap 142 is hingedly connected to the second back panel 124.

The slide-out tray blank 110 further includes a fifth minor bottom flap 144 and a second minor top flap 146. The fifth minor bottom flap 144 is hingedly connected via a fold line to the first minor bottom flap 132*a* and is separated from the front panel 112 via cut lines 148*a*-148*c* as shown in FIG. 2. The second minor top flap 146 is hingedly connected to the back panel 114 via a fold line.

Figure 3:
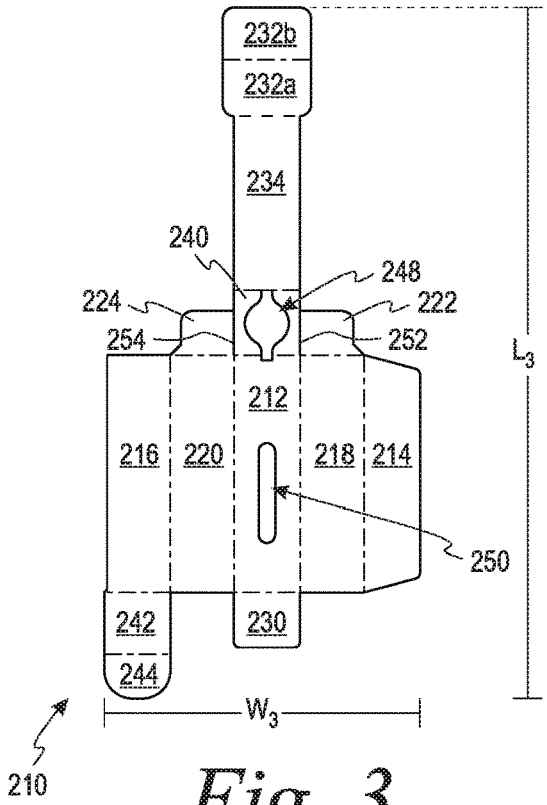
FIG. 3 is a top plan view of a third blank for forming a pop-out carton to be used in a container assembly according to one embodiment of the present disclosure.

Turning now to FIG. 3, a top plan view of a blank 210 (also referred to as an "pop-up carton blank") for forming a pop-up carton to be used in a child-resistant container assembly according to one embodiment of the present disclosure is shown. The pop-up carton blank 210 includes a plurality of panels and a plurality of flaps. Specifically, the pop-up carton 210 includes a front panel 212, a first back panel 214, a second back panel 216, a first side panel 218 and a second side panel 220. Adjacent panels 216, 220, 212, 218, 214 are connected with one another by substantially parallel fold lines as shown in FIG. 3.

The pop-up carton blank 210 further includes a first top minor flap 222 and a second top minor flap 224. These top minor flaps 222, 224 are configured to prevent any contaminants from entering into the carton after being formed from the pop-up carton blank 210. These top minor flaps 222, 224 are configured to be folded inwardly when product is placed within the formed carton. The first and second top minor flaps 222, 224 are hingedly connected to the first and second side panels 218, 220, respectively, via fold lines.

The pop-up carton blank 210 further includes an attachment flap 230, and first and second pop-out tab sections 232*a*, 232*b* that are connected to each other via a fold line as shown in FIG. 2. The attachment flap 230 is hingedly connected to the front panel 212 via a fold line. The attachment flap 230 is configured to attach the pop-up carton and the slide-out tray together as will be discussed below. The first pop-out tab section 232*a* is hingedly connected to a major front flap 234 via a fold line, while the major front flap 234 is hingedly connected to a minor top flap 240 via a fold line. The pop-up tab sections 232*a*, 232*b* assist in popping-out the carton from the slide-out tray during the process of opening the container assembly as will be described below.

The minor top flap 240 is hingedly connected to the front panel 212 via a fold line. The minor top flap 240 forms an aperture 248 therein. The aperture 248 allows a user to easily gain access to the contents in the pop-up carton as will be discussed below. The minor top flap 240 is separated from the first and second top minor flaps 222, 224 by respective cut lines 252, 254. The front panel 212 forms a viewing aperture 250 that is shaped and sized to enable a user to determine if contents remain within the formed pop-up carton. The apertures 248, 250 may be shaped and sized differently than depicted in FIG. 3.

The pop-up carton blank 210 also includes a minor bottom flap 242 and a side minor flap 244. The minor bottom flap 242 is hingedly connected to the second back panel 216 via a fold line, while the side minor flap 244 is hingedly connected to the minor bottom flap 242.

The general dimensions of the outer sleeve blank 10 are shown in FIG. 1A. Specifically, the length L1 of the outer sleeve blank 10 is generally from about 5 inches to about 40 inches and, more specifically, from about 10 to about 30 inches. The length L1 of the outer sleeve blank 10 is typically from about 10 to about 20 inches. The width W1 of the outer sleeve blank 10 is generally from about 4 inches to about 20 inches and, more specifically, from about 5 to about 15 inches. The width W1 of the outer sleeve blank 10 is typically from about 5 to about 10 inches.

The general dimensions of the slide-out tray blank 110 are shown in FIG. 2. Specifically, the length L2 of the slide-out tray blank 110 is generally from about 5 inches to about 20 inches and, more specifically, from about 5 to about 15 inches. The length L2 of the slide-out tray blank 110 is typically from about 5 to about 10 inches. The width W2 of the slide-out tray blank 110 is generally from about 5 inches to about 25 inches and, more specifically, from about 5 to about 15 inches. The width W2 of the slide-out tray blank 110 is typically from about 5 to about 10 inches.

The general dimensions of the pop-up carton blank 210 are shown in FIG. 3. Specifically, the length L3 of the pop-up carton blank 210 is generally from about 5 inches to about 20 inches and, more specifically, from about 5 to about 15 inches. The length L3 of the pop-up carton blank 210 is typically from about 5 to about 10 inches. The width W3 of the pop-up carton blank 210 is generally from about 2 inches to about 12 inches and, more specifically, from about 2 to about 10 inches. The width W3 of the pop-up carton blank 210 is typically from about 2 to about 5 inches.

It is contemplated that the dimensions of the blanks 10, 110, 210 can be designed to have other dimensions and/or relative size proportions. It is noted that the dimensions of the slide-out tray formed from the slide-tray blank must be dimensioned to be able to slide into the outer sleeve formed from the outer-sleeve blank. Additionally, the pop-up carton formed from the pop-up carton blank must be dimensioned to be able to fit into the elongated aperture or opening of the slide-out tray.

The assembly of the outer sleeve blank 10, the slide-out tray blank 110 and the pop-up carton blank 210 (see FIGS. 4-6) will now be described according to one method. Specifically, the formation of the outer sleeve blank 10 to an outer sleeve 60, the slide-out tray blank 110 to a slide-out tray 160, and the pop-up carton blank 210 to a pop-up carton 260 will be described according to one method.

Figure 4A:
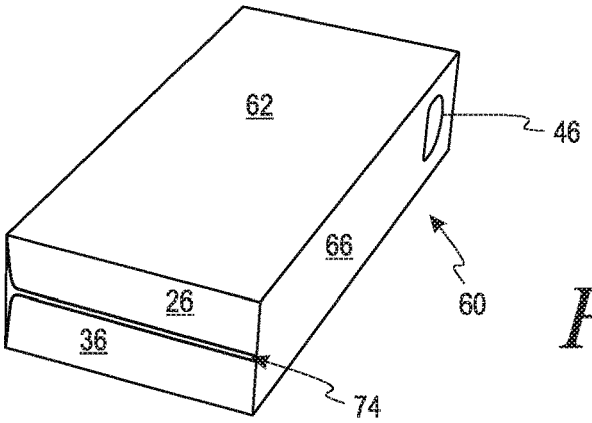
FIG. 4A is a front perspective view of an assembled outer sleeve formed from the first blank of FIG. 1.
Figure 4B:
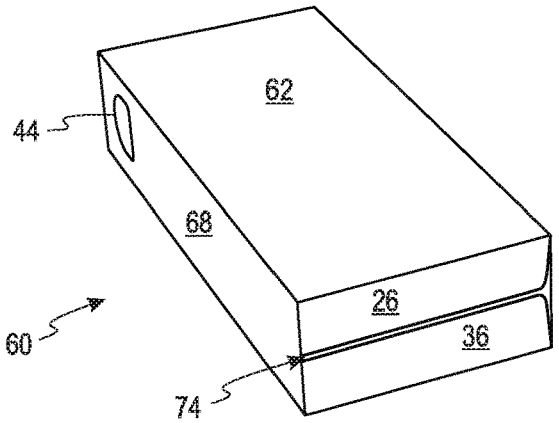
FIG. 4B is another front perspective view of the assembled outer sleeve of FIG. 4A.
Figure 4C:
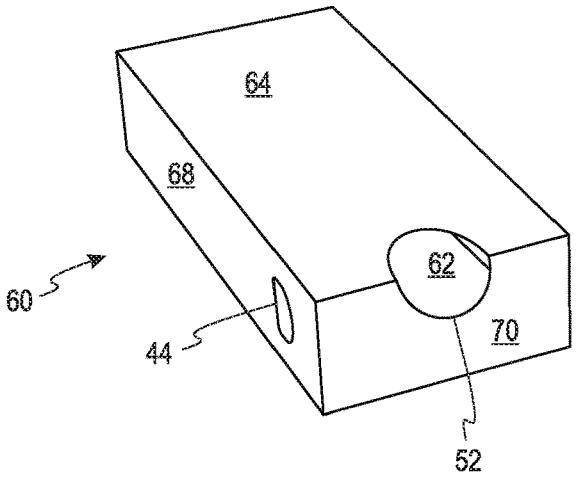
FIG. 4C is a back perspective view of the assembled outer sleeve of FIG. 4A.

As shown in FIGS. 4A-C, the outer sleeve 60 includes a front 62, a back 64, first and second sides 66, 68, and a top 70. The outer sleeve 60 includes an open end 74 for receiving the slide-out tray 160. The open end 74 is located opposite of the top 70.

Figure 1B:
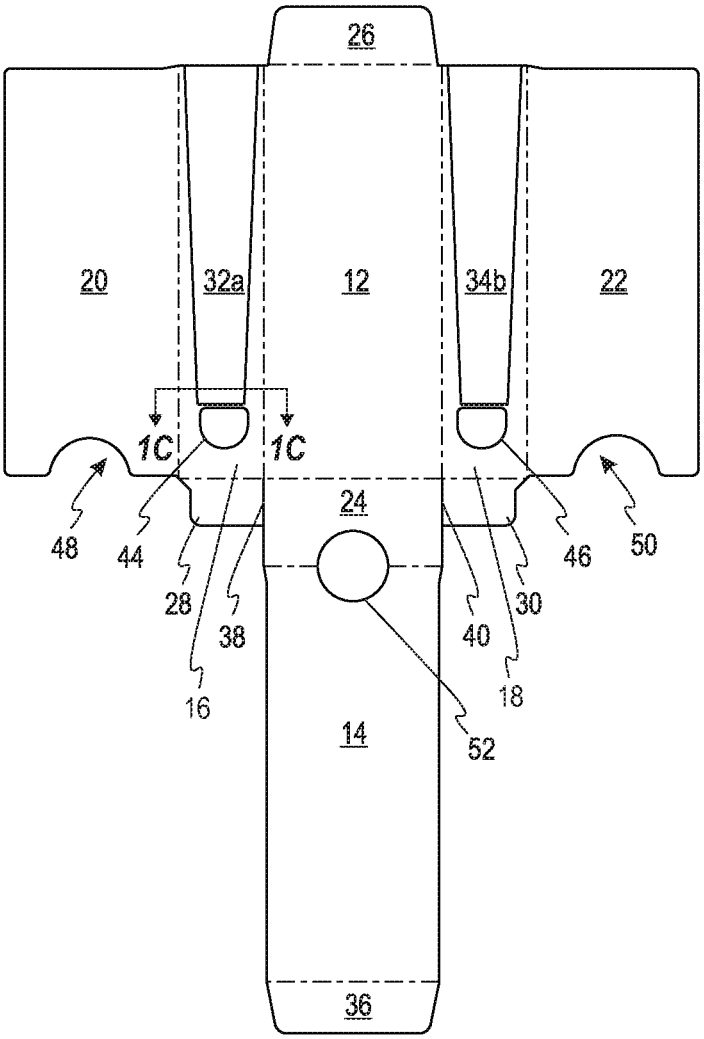
FIG. 1B is a top plan view of the first blank of FIG. 1A after folding a plurality of flaps according to one embodiment of the present disclosure.

According to one method and referring to FIGS. 1A-1C and 4A-4C, the first minor side flap 32*b* is folded over and adhered to the first major side flap 32*a*, and the second minor side flap 34*b* is folded over and adhered to the second major side flap 34*a*. Then, the first major side flap 32*a* is folded inwardly and attached to the first side panel 16. The second major side flap 34*a* is folded inwardly and attached to the second side panel 18. This is shown in FIG. 1B. The first major side flap 32*a* and second major side flap 34*a* are desirably attached to the first side panel 16 and the second side panel 18, respectively, using an adhesive in one embodiment. In such an embodiment, the adhesive is located on at least one of the surfaces of the first major side flap 32*a* and the first side panel 16. Similarly, the adhesive is located on at least one of the surfaces of the second major side flap 34*a* and the second side panel 18.

Figure 1C:
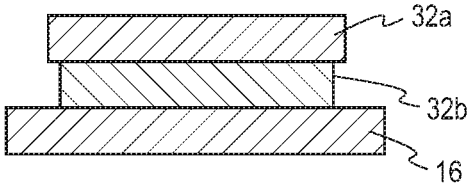
FIG. 1C is an enlarged cross-sectional view taken generally along line 1C-1C of FIG. 1B.

As shown, for example, in FIG. 1B, the folded first major side flap 32*a* and the second major side flap 34*a* extend adjacent to the apertures 44, 46, respectively, but do not desirably cover any portion of the apertures 44, 46. Referring to FIGS. 1B, 1C, the area directly adjacent to the aperture 44 will be of a triple thickness (the thickness of the first major side flap 32*a*, the first minor side flap 32*b* and the first side panel 16). Similarly, the area directly adjacent to the aperture 46 will be of a triple thickness (the thickness of the second major side flap 34*a*, the second minor side flap 34*b* and the second side panel 18). The thickness of these areas adjacent to the apertures 44, 46 assist in the child-resistant aspect of the container assembly as will be discussed below.

The first major back flap 20 and the second major back flap 22 are folded inwardly and attached to each other via an adhesive in one method. The adhesive may be located on the first major back flap 20, the second major back flap 22, or both. The second minor top flap 28 and the third minor top flap 30 are folded inwardly and will eventually form part of the top 70 of the outer sleeve 60. The back panel 14 is then folded inwardly and attached to one of the first major back flap 20 and the second major back flap 22 via an adhesive. The adhesive may be located on the back panel 14, the major back flap 20 or the major back flap 22, or both the back panel 14 and one of the major back flaps 20, 22. After the back panel 14 is folded inwardly and attached, the first minor top flap 24 is attached over and on top of the second minor top flap 28 and the third minor top flap 30 via an adhesive. The top flaps 24, 28 and 30 form the top 70 of the outer sleeve 60.

The first minor front flap 26 is folded inwardly towards the front panel 12. The first minor back flap 36 is folded inwardly towards the back panel 14. As will be discussed below, the first minor front flap 26 is configured to assist in moving the pop-up carton between open and closed positions, while the first minor back flap 36 assists in preventing or inhibiting the slide-out tray from being removed from the outer sleeve. The open end 74 of the outer sleeve 60 is configured to receive a formed slide-out tray.

It is contemplated that the steps of forming the outer sleeve 60 from the outer sleeve tray blank 10 may be done sequentially in a different order than that described in the method above.

Figure 5A:
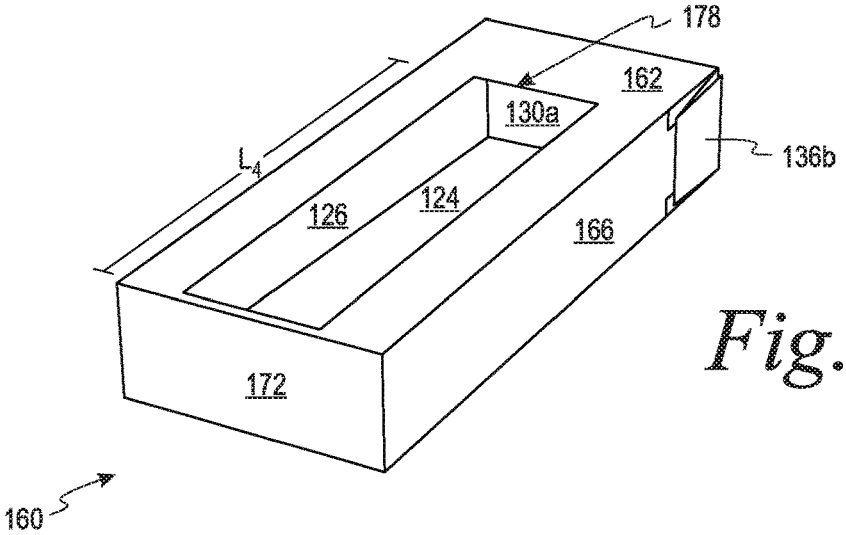
FIG. 5A is a front perspective view of an assembled slide-out tray formed from the second blank of FIG. 2.
Figure 5B:
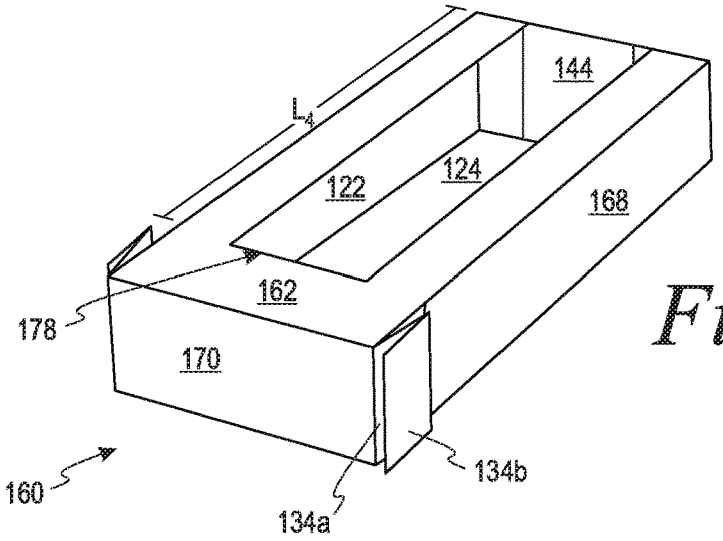
FIG. 5B is another front perspective view of the assembled slide-out tray of FIG. 5A.
Figure 5C:
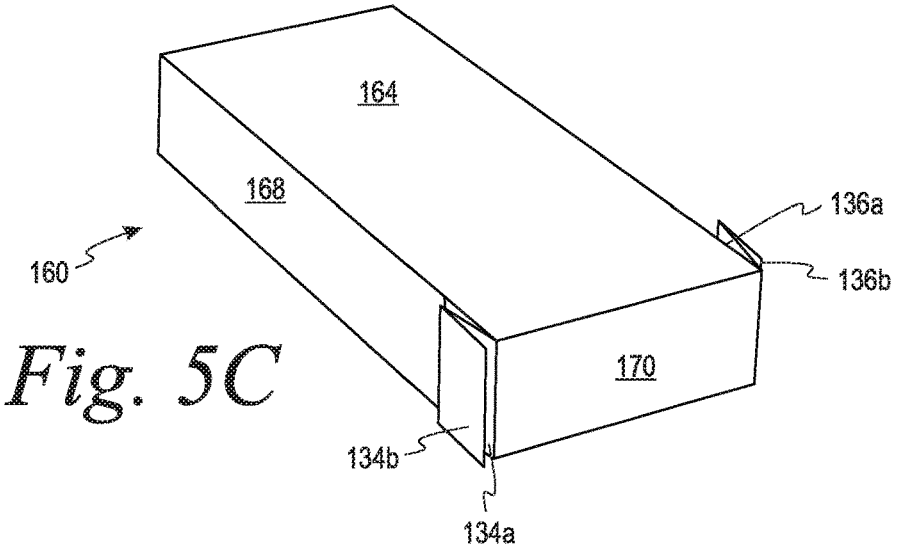
FIG. 5C is a back perspective view of the assembled slide-out tray of FIG. 5A.

As shown in FIGS. 5A-C, the slide-out tray 160 includes a front 162, a back 164, first and second sides 166, 168, a top 170 and a bottom 172. The slide-out tray 160 further includes an elongated area or groove 178. The slide-out tray 160 is configured to be received into the open end 74 of the outer sleeve 60.

To form the slide-out tray 160 and referring to FIGS. 2 and 5A-5C, the panels 118, 120, 122, 124, 126 and 128 are folded inwardly. The second back panel 124 is attached to the first back panel 114 via an adhesive. The adhesive may be located on the second back panel 124, the first back panel 114, or both of the panels 114, 124. During this folding, the first interior side panel 122 forms an inner side wall that is spaced from the second side panel 118 by a distance D1 of the first minor front panel 120. The front panel 112 is folded inwardly and the first minor front panel 120 and the second minor front panel 128 are attached to the front panel 112 via, for example, an adhesive. The adhesive may be located on the first and second minor front panels 120, 128, the front panel 112, or all of the panels. The second interior side panel 126 forms a second interior side wall that is spaced from the first side wall 116 by a distance D2 of the second minor front panel 128.

The fifth minor bottom flap 144 is folded inwardly and then the fourth minor bottom flap 142 is folded upwardly and inwardly so as to be attached to the fifth minor bottom flap 144 via an adhesive. The adhesive may be located on the fifth minor bottom flap 144, the fourth minor bottom flap 142, or both. The fifth minor bottom flap 144 and the second minor bottom flap 142 form a portion of the bottom 172 of the slide-out tray 160. The second and third minor bottom flaps 138 and 140 are folded inwardly to be directly adjacent to the fourth minor bottom flap 142. The first minor bottom flap 132*a* and the second minor back flap 132*b* are folded inwardly in which the second minor back flap 132*b* is tucked underneath a portion of the second back panel 124. Thus, the adhesive used in attaching the first back panel 114 and the second back panel 124 does not extend to an area where the second minor back flap 132*b* is to be tucked underneath. The bottom 172 of the slide-out tray 160 includes the first, second, third, fourth and fifth minor bottom flaps 132*a*, 138, 140, 142, 144.

To create the top 170 of the slide-out tray 160, the first minor top flap 130*a* and the first minor back flap 130*b* are folded over such that the first minor back flap 130*b* is tucked under the second back panel 124. Thus, the adhesive used in attaching the first back panel 114 and the second back panel 124 does not extend to an area where the first minor back flap 130*b* is to be tucked underneath. The second minor top flap 146 is folded inwardly and attached to the first minor top flap 130*a* via an adhesive. The adhesive may be located on the second minor top flap 146, the first minor top flap 130*a*, or both flaps 146, 130*a*. The first minor top flap 130*a* and the second minor top flap 146 form the top 170 of the slide-out tray 160.

The first and second minor side flaps 134*a*, 134*b* are folded accordion style toward the first side panel 116. The minor side flaps 134*a*, 134*b* are not secured to the first side panel 116. Similarly, the third and fourth minor side flaps 136*a*, 136*b* are folded accordion style toward the second side panel 118. The minor side flaps 136*a*, 136*b* are not secured to the second side panel 118.

The area or groove 178 is formed within the boundaries of the first and second interior side panels 122, 126, the second back panel 124, the fifth minor bottom flap 144 and the first minor top flap 130*a*. The area or groove 178 is adapted and sized to contain the pop-up carton 260 therein. Thus, the length L4 of the area or groove 178 of FIGS. 5A, 5B is greater than the length L5 of the pop-up carton 260 shown in FIG. 6A. The length L4 of the area or groove 178 is also desirably greater than the length L5 of the pop-up carton 260 to account for any length of product that extends out of the pop-up carton 260. By having the product extend from the pop-up carton 260, a user can more easily remove the product.

It is contemplated that the steps of forming the slide-out tray 160 from the slide-out tray blank 110 may be done sequentially in a different order than that described in the method above.

Figure 6A:
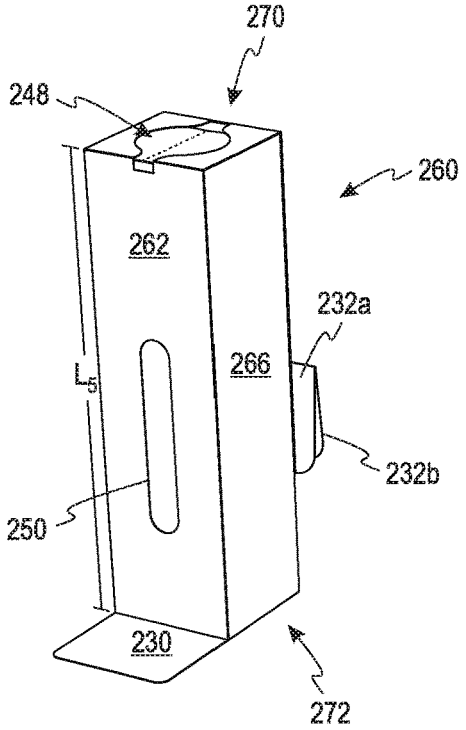
FIG. 6A is a top perspective view of an assembled pop-up carton formed from the third blank of FIG. 3.
Figure 6B:
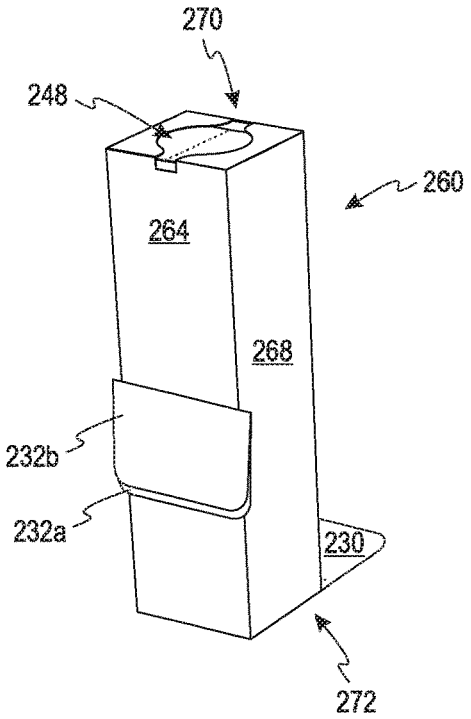
FIG. 6B is another top perspective view of the assembled pop-up carton of FIG. 6A.

As shown in FIGS. 6A-C, the pop-up carton 260 includes a front 262, a back 264, first and second sides 266, 268, a top 270 and a bottom 272. The front 262 of the pop-up carton 260 includes the elongated aperture 250. As will be discussed below, the pop-up carton 260 is configured to be placed into the area or groove 178 of the slide-out tray 160.

To initiate the process of forming the pop-up carton 260, as shown in FIGS. 3, 6A and 6B, the first back panel 214, the first side panel 218, the second back panel 216, and the second side panel 220 are folded inwardly. The first back panel 214 and the second back panel 216 are attached via, for example, an adhesive. It is contemplated that at least one surface of the first back panel 214 and the second back panel 216 includes an adhesive.

To form the bottom 272 of the pop-up carton 260, the side minor flap 244 is folded inwardly and attached to an inner surface of the front panel 212 via an adhesive. It is contemplated that at least one surface of the side minor flap 244 and the front panel 212 includes an adhesive. The minor bottom flap 242 forms the bottom 272 of the pop-up carton 260.

To form the top 270 of the pop-up carton 260, the first and second top minor flaps 222, 224 are folded inwardly but are not attached to any surface. The minor top flap 240 with aperture 248 formed therein is folded to cover the first and second top minor flaps 222, 224. During the folding over of the minor top flap 240, the major front flap 234 is attached to the first or second back panel 214, 216 via an adhesive. At least one surface of the major front flap 234 and the first or second back panels 214, 216 includes an adhesive. In this embodiment, the major front flap 234 is attached to second back panel 216. The second pop-out tab section 232*b* is folded accordion style over the first pop-out tab section 232*a*.

It is contemplated that the steps of forming the pop-up carton 260 from the pop-up carton blank 210 may be done sequentially in a different order than that described in the method above.

Figure 7A:
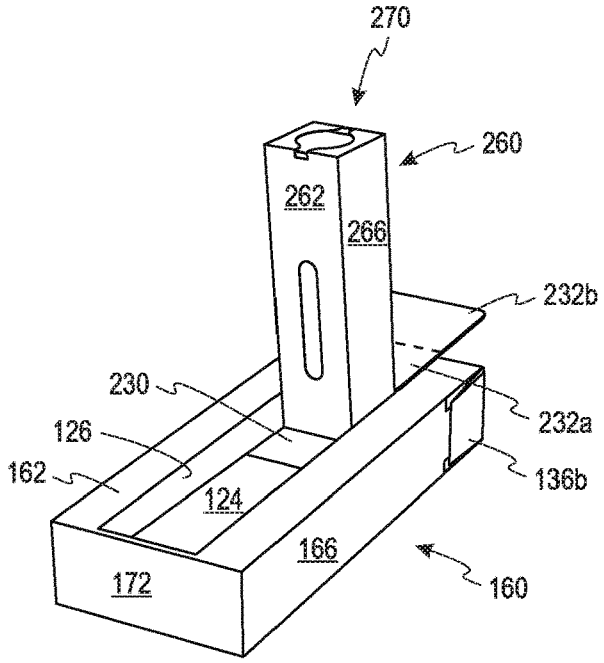
FIG. 7A is a front perspective view of the assembled slide-out tray of FIGS. 5A-C and assembled pop-up carton of FIGS. 6A, 6B after attachment according to one method.
Figure 7B:
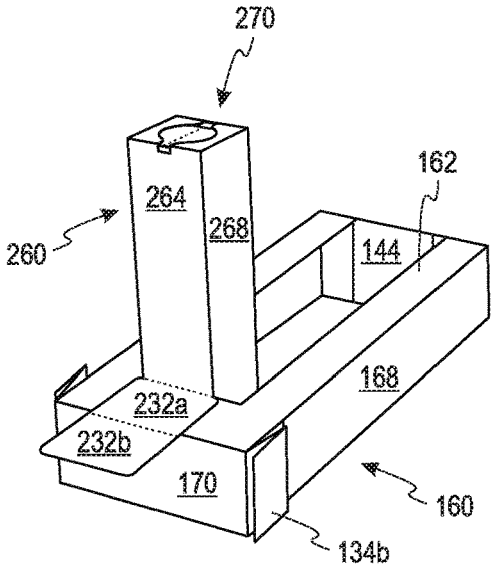
FIG. 7B is a back perspective view of the assembled slide-out tray of FIGS. 5A-C and assembled pop-up carton of FIGS. 6A, 6B after attachment according to one method.

To form the child-resistant container assembly, the pop-up carton 260 is initially attached to the slide-out tray 160 as shown in FIGS. 7A, 7B. Specifically, the attachment flap 230 of the pop-up carton 260 is attached to a surface of the second back panel 124 via an adhesive. The adhesive may be located on the attachment flap 230, the second back panel 124 or both. The positioning of the attachment flap 230 is such that the pop-up carton 260 is capable of being moved from a closed or flat position to an open or generally perpendicular position to the remainder of the container assembly. This is shown in, for example, FIGS. 8A-8C, 9A-9C. It is desirable that when the pop-up carton 260 is in the open or generally perpendicular position, that it abuts against one of the inner surfaces that forms the area or groove 178 of the slide-out tray 150 and/or bottom edge of the outer sleeve 60 so as to provide additional support to the pop-up carton 260 in a fully open position. This is shown best in FIG. 8C. The slide-out tray 160 with the attached pop-up carton 260 in a flat or closed position is then slid into the open end 74 of the outer sleeve 60.

Figure 8A:
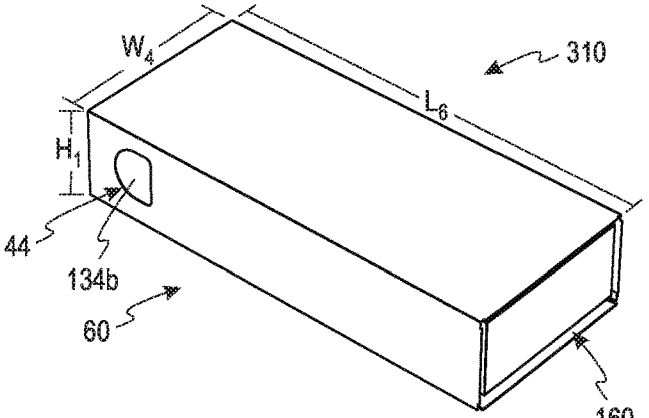
FIG. 8A is a front perspective view of a container assembly formed from the blanks of FIGS. 1-3 in a first or closed position.
Figure 8B:
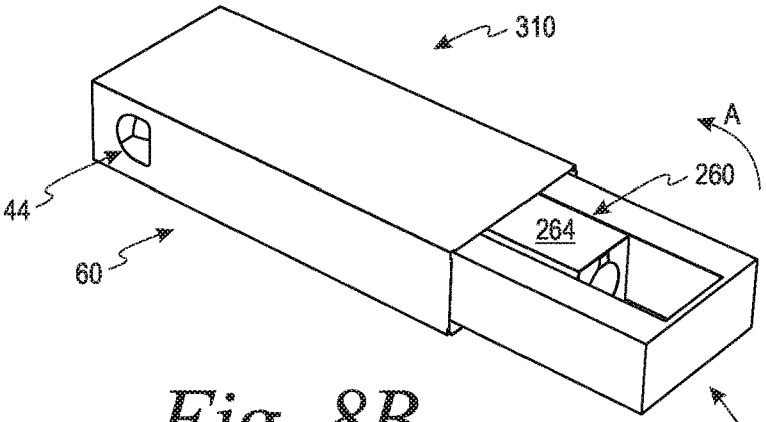
FIG. 8B is a front perspective view of the container assembly formed from the blanks of FIGS. 1-3 in a second position.
Figure 8C:
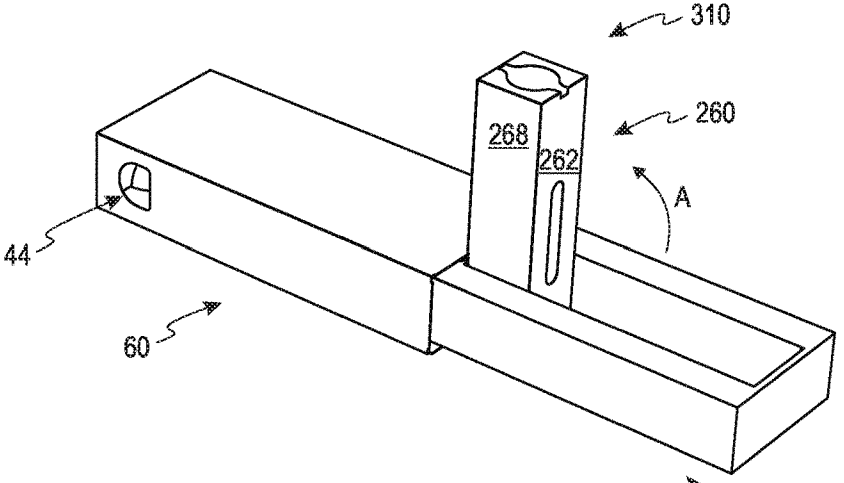
FIG. 8C is a front perspective view of the container assembly formed from the blanks of FIGS. 1-3 in a third or fully open position.
Figure 8D:
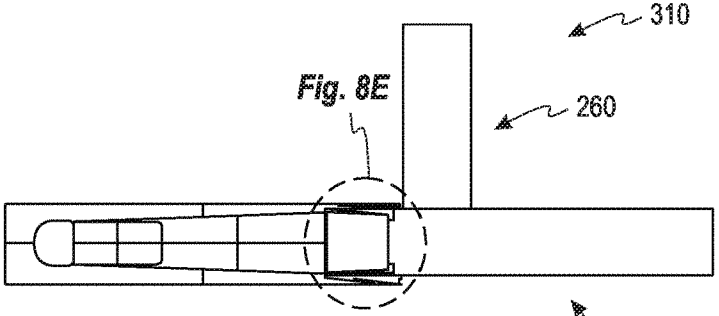
FIG. 8D is a side view of the assembled blank container assembly formed from the blanks of FIGS. 1-3 in a first or closed position.
Figure 8E:
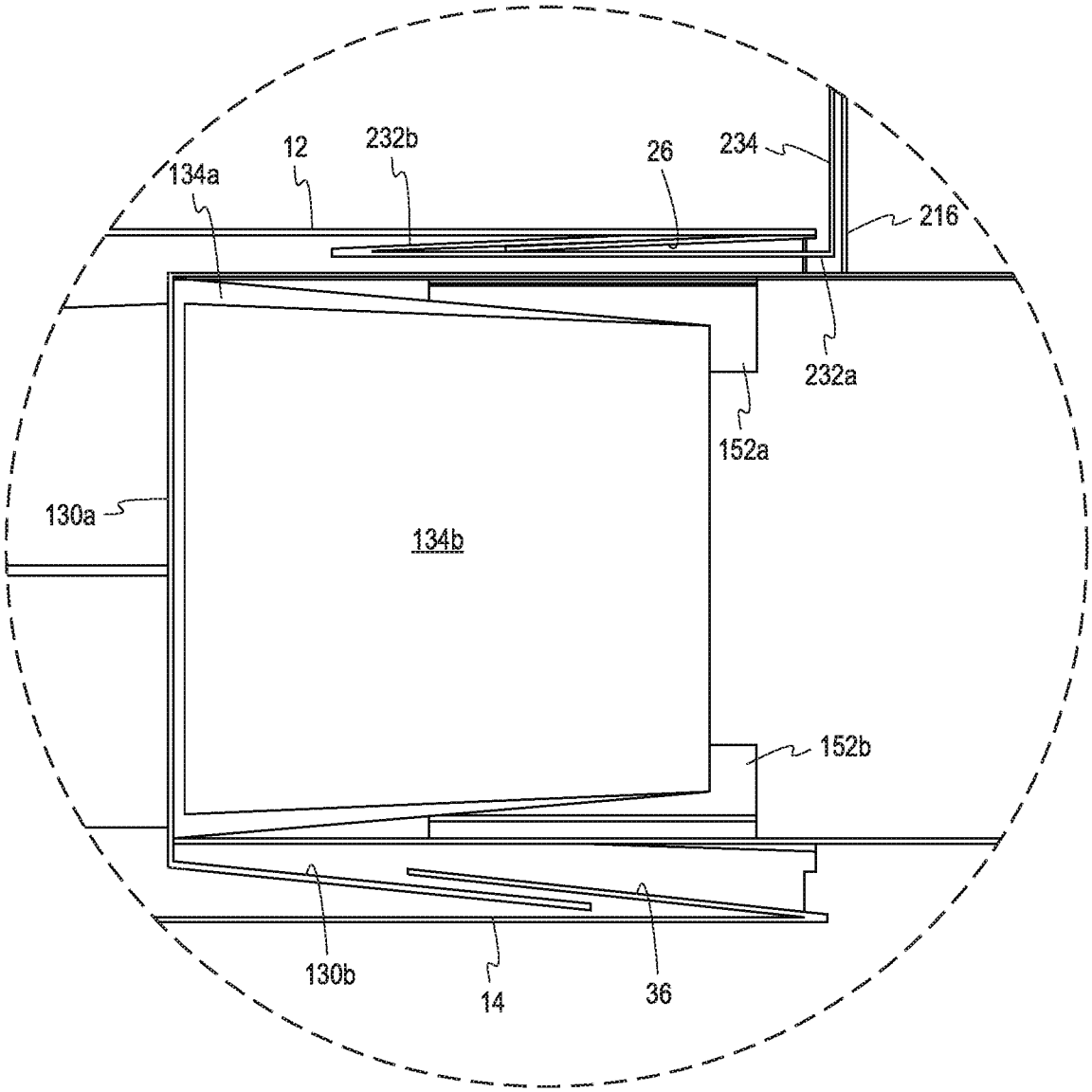
FIG. 8E is an enlarged side view taken from FIG. 8D.

The relationship of the attachment between the pop-up carton 260 and the outer sleeve 60 is shown with respect to FIGS. 8D, 8E. Referring to FIG. 8E specifically, the first pop-out tab section 232*a* is shown being folded from the major front flap 234 of the pop-up carton 260. The second pop-up tab section 232*b* is located between the front panel 12 of the outer sleeve 60 and the first minor front flap 26. This configuration shown in FIG. 8E assists in moving the pop-up carton from a flat position (FIG. 8A) to a fully open position (FIG. 8C).

FIG. 8E also shows how the slide-out tray 160 is prevented or inhibited from being completely removed from the outer sleeve 60. Specifically, the first minor back flap 36 that extends from the back panel 14 of the outer sleeve 60 assists in capturing the first minor back flap 130*b*, which prevents or inhibits the slide-out tray 160 from being removed from the outer sleeve 60.

Referring back to FIGS. 8A-C and 9A-C, a child-resistant container assembly 310 is depicted that includes the outer sleeve 60, the slide-out tray 160 and the pop-up carton 260. FIGS. 8A-C depict the child-resistant container assembly 310 in a front perspective view, while FIGS. 9A-C depict the child resistant container assembly 310 in a back perspective view.

Figure 9A:
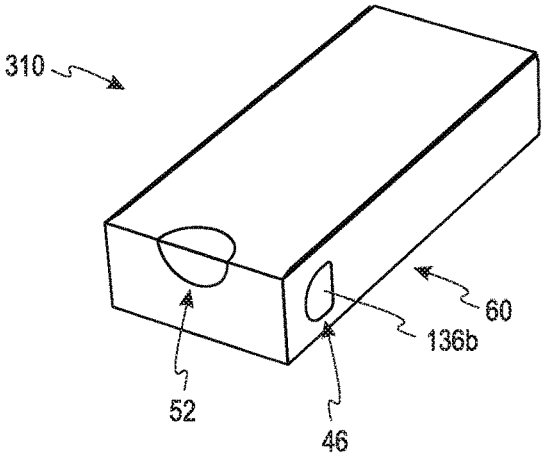
FIG. 9A is a back perspective view of a container assembly formed from the blanks of FIGS. 1-3 in a first or closed position.

FIGS. 8A and 9A depict the child-resistant container assembly 310 in a closed position. FIGS. 8C and 9C depict the child-resistant container assembly 310 in a fully open position. To move the child resistant container assembly from a closed position to a fully open position, a user simultaneously (a) presses the first and second minor side flaps 134*a*, 134*b* of the slide-out tray 160 via the aperture 44 of the outer sleeve 60; (b) presses the third and fourth minor flaps 136*a*, 136*b* of the slide-out tray 160 via the aperture 46 of the outer sleeve 60; and (c) pushes the top 170 of the slide-out tray 160 via the aperture 52 formed in the outer sleeve 60. This operation may be performed by one hand or, alternatively, may be performed by two hands.

By pressing inward on the first and second minor side flaps 134*a*, 134*b* and the third and fourth minor flaps 136*a*, 136*b*, the slide-out tray 160 clears or releases over the triple thickness of the outer sleeves described above in FIGS. 1B, 1C. Specifically, the first and second minor flaps 134*a*, 134*b* clear or release over the attached first major and first minor side flaps 32*a*, 32*b*, while the third and fourth minor side flaps 136*a*, 136*b* clear or release over the second major and second minor side flaps 34*a*, 34*b*. If the user does not press both the first and second minor side flaps 134*a*, 134, and the third and fourth minor side flaps 136*a*, 136*b*, the slide-out tray 160 is prevented or inhibited from being moved by the first major and first minor side flaps 32*a* 32*b*, and/or the second major and second minor side flaps 34*a*, 34*b*.

Figure 9B:
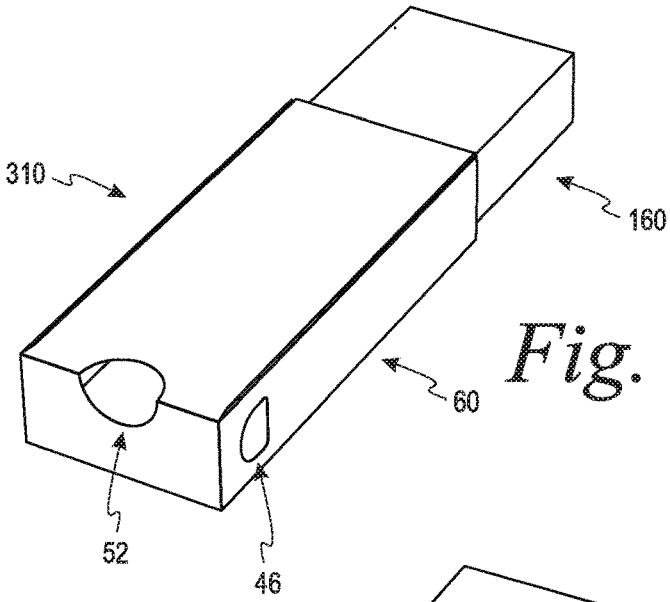
FIG. 9B is a back perspective view of the container assembly formed from the blanks of FIGS. 1-3 in a second position.
Figure 9C:
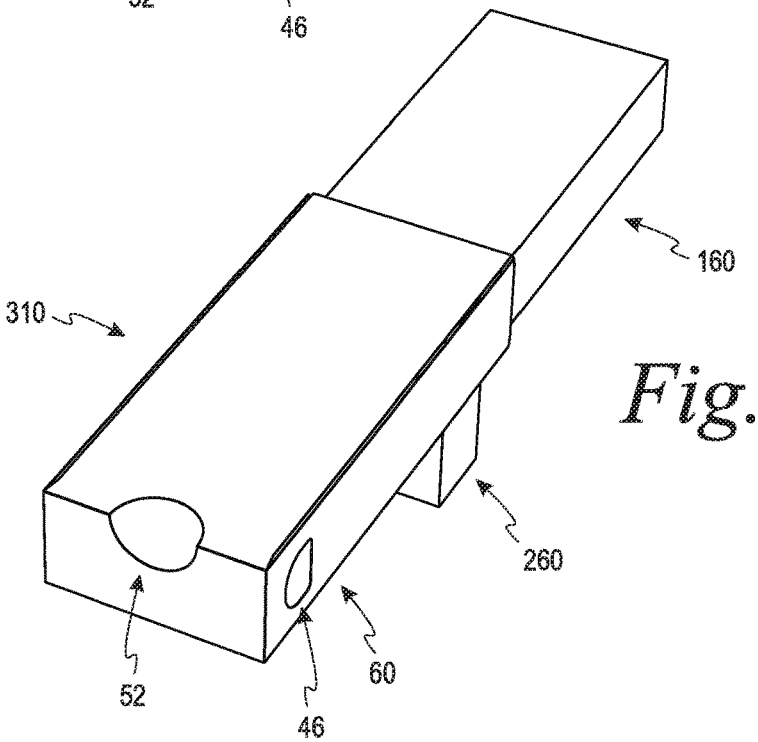
FIG. 9C is a back perspective view of the container assembly formed from the blanks of FIGS. 1-3 in a third or fully open position.

Once the slide-out tray is initially moved from the closed positon (FIGS. 8A, 9A), the child-resistant container assembly 310 is moved to a second position that is shown in FIGS. 8B, 9B. As the slide-out tray 260 is continued to be moved, the pop-up carton 260 is moved to a fully open position as shown in FIGS. 8C, 9C via the direction of arrow A. The pop-up carton 260 of FIG. 8C is shown as being generally or substantially perpendicular to the remainder of the child-resistant container assembly 310.

Once the container assembly 310 is in the fully open position, products within the pop-up carton 260 can be accessed through the top 270. It is contemplated that product may be removed even before the pop-up carton 260 is in the fully open position.

It is contemplated that many different of products may be included in the child-resistant container assembly including, but not limited to marijuana, e-cigarettes, cigarettes, lipstick, makeup, candy and pens. Typically, the products to be included are those that are desirable to keep away from children. It is contemplated, however, that other products that are safe with children may be included in the container assembly.

It is contemplated that the container assembly may include advertising features, descriptions, graphics, or other information thereon. Some additional information may include written or visual instructions on how to access the contents of the child-resistant container assembly 310.

The general dimensions of the container assembly 310 are shown in FIG. 8A. Specifically, the length L6 of the container assembly 310 is generally from about 2 inches to about 15 inches and, more specifically, from about 3 to about 10 inches. The length L6 of the container assembly 310 is typically from about 3 to about 6 inches. The width W4 of the container assembly 310 is generally from about 1.5 inches to about 8 inches and, more specifically, from about 2 to about 6 inches. The width W4 of the container assembly 310 is typically from about 2 to about 4 inches. The height H1 of the container assembly 310 is generally from about 0.5 inches to about 4 inches and, more specifically, from about 0.5 to about 3 inches. The height H1 of the container assembly 310 is typically from about 0.5 to about 1.5 inches.

The container assemblies of the embodiments described herein are typically manufactured using paperboard. The paperboard to form to each of the blanks is desirably formed from a single sheet. It is contemplated that the paperboard may be formed from multiple sheets.

It is to be understood that the principles of this invention could be applied to containers made of other materials, such as corrugated paperboards, cardboard, corrugated fiberboard, non-corrugated fiberboard, solid-fiber board, polymeric materials, foldable metals and other foldable materials. Corrugated paperboard generally refers to a multi-layer sheet material comprised of two sheets of liner bonded to a central corrugated layer of medium. It is contemplated that the materials for forming the different blanks may be made of different materials.

While the container assemblies of the embodiments described above include adhesive or glue for attaching various panels and flaps of the container assemblies, it is contemplated that any other suitable method of joining or attaching panels and flaps may be utilized such as, for example, staples, tapes, a system of corresponding slits and tabs, combinations thereof, and/or the like.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container assembly comprising:

an outer sleeve including a front, a back, first and second sides, a top and an open end opposite of the top, the first and second sides forming respective first and second outer sleeve apertures, at least one of the back and the top of the outer sleeve forming a third outer sleeve aperture, the first and second sides having at least a double thickness adjacent to the first and second outer sleeve apertures;

a slide-out tray including a front, a back, first and second sides, and a bottom, the slide-out tray forming an elongated area, the first side of the slide-out tray including at least one minor first side flap folded thereon, the second side of the slide-out tray including at least one minor second side flap folded thereon, the slide-out tray being received in the open end of the outer sleeve; and a pop-up carton including a front, a back, first and second sides, a bottom, and a top, the pop-up carton being attached to the slide-out tray and being located within the elongated area of the slide-out tray in a first position, wherein the slide-out tray is configured to initially move with respect to the outer sleeve by contacting (a) the at least one minor first side flap of the slide-out tray via the first outer sleeve aperture, (b) the at least one minor second side flap of the slide-out tray via the second outer sleeve aperture, and (c) the slide-out tray via the third outer sleeve aperture, wherein the pop-up carton is moved from the first position within the slide-out tray to a second position extending from the slide-out tray during the movement of the slide-out tray with respect to the outer sleeve, wherein the outer sleeve includes a minor back flap to assist in preventing or inhibiting the slide-out tray from being removed from the outer sleeve.

2. The container assembly of claim 1, wherein the back and the top of the outer sleeve form the third outer sleeve aperture.

3. The container assembly of claim 2, wherein the third outer sleeve aperture is in a general circular shape.

4. The container assembly of claim 1, wherein the first and second outer sleeve apertures are generally semicircle shaped.

5. The container assembly of claim 1, wherein the first and second sides have at least a triple thickness adjacent to the first and second outer sleeve apertures.

6. The container assembly of claim 1, wherein the slide-out tray further includes a top.

7. The container assembly of claim 1, wherein the slide-out tray further includes first and second interior side walls.

8. A container assembly comprising:

an outer sleeve including a front, a back, first and second sides, a top and an open end opposite of the top, the first and second sides forming respective first and second outer sleeve apertures, at least one of the back and the top of the outer sleeve forming a third outer sleeve aperture, the first and second sides having at least a double thickness adjacent to the first and second outer sleeve apertures;

a slide-out tray including a front, a back, first and second sides, and a bottom, the slide-out tray forming an elongated area, the first side of the slide-out tray including at least one minor first side flap folded thereon, the second side of the slide-out tray including at least one minor second side flap folded thereon, the slide-out tray being received in the open end of the outer sleeve; and a pop-up carton including a front, a back, first and second sides, a bottom, and a top, the pop-up carton being attached to the slide-out tray and being located within the elongated area of the slide-out tray in a first position, wherein the slide-out tray is configured to initially move with respect to the outer sleeve by contacting (a) the at least one minor first side flap of the slide-out tray via the first outer sleeve aperture, (b) the at least one minor second side flap of the slide-out tray via the second outer sleeve aperture, and (c) the slide-out tray via the third outer sleeve aperture, wherein the pop-up carton is moved from the first position within the slide-out tray to a second position extending from the slide-out tray during the movement of the slide-out tray with respect to the outer sleeve, wherein the at least one minor first side flap of the slide-out tray includes two minor first side flaps folded in accordion style, and wherein the at least one minor second side flap of the slide-out tray includes two minor second side flaps folded in accordion style.

9. The container assembly of claim 1, wherein the first side of the slide-out tray includes at least aperture and the second side of the slide-out tray includes at least one aperture, the at least one aperture of the first side of the slide-out tray being located adjacent to the at least one minor first side flap, the at least one aperture of the second side of the slide-out tray being located adjacent to the at least one minor second side flap.

10. The container assembly of claim 9, wherein the at least one aperture of the first side of the slide-out tray includes two apertures being connected by a cut line, and wherein the at least one aperture of the second side of the slide-out tray includes two apertures being connected by a cut line.

11. The container assembly of claim 1, wherein the top of the pop-up carton forms an aperture.

12. The container assembly of claim 1, wherein the front of the pop-up carton forms an aperture configured to view whether there is product located within the pop-up carton.

13. A container assembly comprising:

an outer sleeve including a front, a back, first and second sides, a top and an open end opposite of the top, the first and second sides forming respective first and second outer sleeve apertures, at least one of the back and the top of the outer sleeve forming a third outer sleeve aperture, the first and second sides having at least a double thickness adjacent to the first and second outer sleeve apertures;

a slide-out tray including a front, a back, first and second sides, and a bottom, the slide-out tray forming an elongated area, the first side of the slide-out tray including at least one minor first side flap folded thereon, the second side of the slide-out tray including at least one minor second side flap folded thereon, the slide-out tray being received in the open end of the outer sleeve; and a pop-up carton including a front, a back, first and second sides, a bottom, and a top, the pop-up carton being attached to the slide-out tray and being located within the elongated area of the slide-out tray in a first position, wherein the slide-out tray is configured to initially move with respect to the outer sleeve by contacting (a) the at least one minor first side flap of the slide-out tray via the first outer sleeve aperture, (b) the at least one minor second side flap of the slide-out tray via the second outer sleeve aperture, and (c) the slide-out tray via the third outer sleeve aperture, wherein the pop-up carton is moved from the first position within the slide-out tray to a second position extending from the slide-out tray during the movement of the slide-out tray with respect to the outer sleeve, wherein the pop-up carton includes first and second pop-up tab sections, the outer sleeve including a minor front flap, and wherein the first and second pop-up tab sections and the minor front flap of the outer sleeve assist in moving the pop-up carton between the first position and the second position.

14. The container assembly of claim 1, wherein the second position is a fully open position in which the slide-out tray is generally perpendicular to a remainder of the container assembly.

15. The container assembly of claim 1 further including product located within the pop-up carton.

16. A method of accessing product from a child-resistance container assembly, the method comprising:

providing an outer sleeve including a front, a back, first and second sides, a top and an open end opposite of the top, the first and second sides forming respective first and second outer sleeve apertures, at least one of the back and the top of the outer sleeve forming a third outer sleeve aperture, the first and second sides having at least a double thickness adjacent to the first and second outer sleeve apertures;

providing a slide-out tray including a front, a back, first and second sides, and a bottom, the slide-out tray forming an elongated area, the first side of the slide-out tray including at least one minor first side flap folded thereon, the second side of the slide-out tray including at least one minor second side flap folded thereon, the slide-out tray being received in the open end of the outer sleeve; and providing a pop-up carton including a front, a back, first and second sides, a bottom, and a top, the pop-up carton being attached to the slide-out tray and being located within the elongated area of the slide-out tray in a first position;

moving the sliding tray with respect to the outer sleeve by contacting (a) the at least one minor first side flap of the slide-out tray via the first outer sleeve aperture, (b) the at least one minor second side flap of the slide-out tray via the second outer sleeve aperture, and (c) the slide-out tray via the third outer sleeve aperture; and moving the pop-up carton from the first position within the slide-out tray to a second position extending from the slide-out tray during the movement of the slide-out tray with respect to the outer sleeve such that product is removable, wherein the outer sleeve includes a minor back flap to assist in preventing or inhibiting the slide-out tray from being removed from the outer sleeve.

17. The method of claim 16, wherein the second position is a fully open position in which the slide-out tray is generally perpendicular to a remainder of the container assembly.

18. The method of claim 16, wherein the at least one minor first side flap of the slide-out tray includes two minor first side flaps folded in accordion style, and wherein the at least one minor second side flap of the slide-out tray includes two minor second side flaps folded in accordion style.

19. The method of claim 16, wherein the pop-up carton includes first and second pop-up tab sections, the outer sleeve including a minor front flap, and wherein the first and second pop-up tab sections and the minor front flap of the outer sleeve assist in moving the pop-up carton between the first position and the second position.

* * * * *